US006193540B1

(12) United States Patent
Tseng

(10) Patent No.: US 6,193,540 B1
(45) Date of Patent: Feb. 27, 2001

(54) SOCKET LOCK FOR ORNAMENT BULBS

(76) Inventor: Jeou-Nan Tseng, No. 539, Sec. 4, Chunghua Rd., Hsinchu (TW)

( * ) Notice: Subject to any disclaimer, the term of this patent is extended or adjusted under 35 U.S.C. 154(b) by 0 days.

(21) Appl. No.: 09/257,632

(22) Filed: Feb. 25, 1999

(51) Int. Cl.[7] ..... H01R 13/627
(52) U.S. Cl. ..... 439/356; 439/358; 362/226
(58) Field of Search ..... 439/357, 356, 439/358; 362/226

(56) References Cited

U.S. PATENT DOCUMENTS 4,970,632 * 11/1990 Tseng ..... 362/226
5,428,516 * 6/1995 Harris ..... 362/226
5,647,759 * 7/1997 Lien ..... 439/356
5,803,591 * 9/1998 Lin ..... 362/226

* cited by examiner

*Primary Examiner*—Lincoln Donovan
*Assistant Examiner*—Brian S. Webb
(74) *Attorney, Agent, or Firm*—Dorsey & Whitney LLP

(57) ABSTRACT

A socket lock for ornament bulbs between the bulb base and socket includes a T-shaped latch and two attachment blocks. The T-shaped latch includes a tongue and a tapered lock. When the bulb base is inserted into the socket, the lock of the latch slides over the attachment block and fills the gap to lock the bulb base and the socket together. Particularly, the socket lock is easily released by breaking the T-shaped latch from the attachment blocks and pulling the bulb base out of the socket.

6 Claims, 7 Drawing Sheets

SOCKET LOCK FOR ORNAMENT BULBS

BACKGROUND OF THE INVENTION

1. Field of the Invention

The present invention relates to a socket lock for an ornament bulb, which comprises a latch and a retaining groove to lock a bulb base in a socket.

2. Description of Related Art

A conventional method of joining an ornament bulb to a socket is a simple press joint. However, the disadvantage of the press joint is that the bulb may be loosened from the socket, because of thermal deformation caused by temperature changes.

To rectify the above defect, a lock joint was developed that included a latch and corresponding attachment block. The latch can be folded to lock with the attachment block. However, the production costs increase dramatically with the requisite manual labor required to fold and lock the latch with the attachment block for the great number of bulbs.

As shown in FIG. 11, a wedge joint at the junction of the socket (90) and the bulb base (80) includes a wedge (82) and two corresponding semicircular attachment blocks (92). The wedge (82) is integrally formed at the end of a horizontal radial post integrally formed at the top of the bulb base (80). The two attachment blocks (92) define a gap (94) therebetween, and each has a flat bottom surface attached on the top of the socket (90). The width of the gap (94) is slightly smaller than that of the upper end of the wedge (82).

To install the bulb base (80) into the socket (90), the wedge (82) is pushed into the gap (94) till the upper edge of the wedge (82) abuts the bottom edge of the attachment block (92). Then, the attachment blocks (92) retain the wedge (82) therebetween and thereunder.

The wedge joint is easy to assemble, but still there is a problem of replacement, especially when replacement of a failed bulb is necessary. Therefore, a more advanced joint method needs to be developed.

SUMMARY OF THE INVENTION

The main object of the present invention is to provide a lock joint between an ornamental bulb and a socket, which comprises a T-shaped latch and two attachment blocks respectively on the bulb base and the socket at the joint. When the bulb base is inserted into the socket, the latch beside the base or socket slides over the fixture blocks being inserted into a corresponding gap, which is defined between the two attachment blocks, and the bulb is lock therein. When the bulb needs to be released from the socket, a person can easily detach the T-shaped latch from the attachment blocks and pull the bulb out of the socket.

DETAILED DESCRIPTION OF PREFERRED EMBODIMENT

Figure 1:
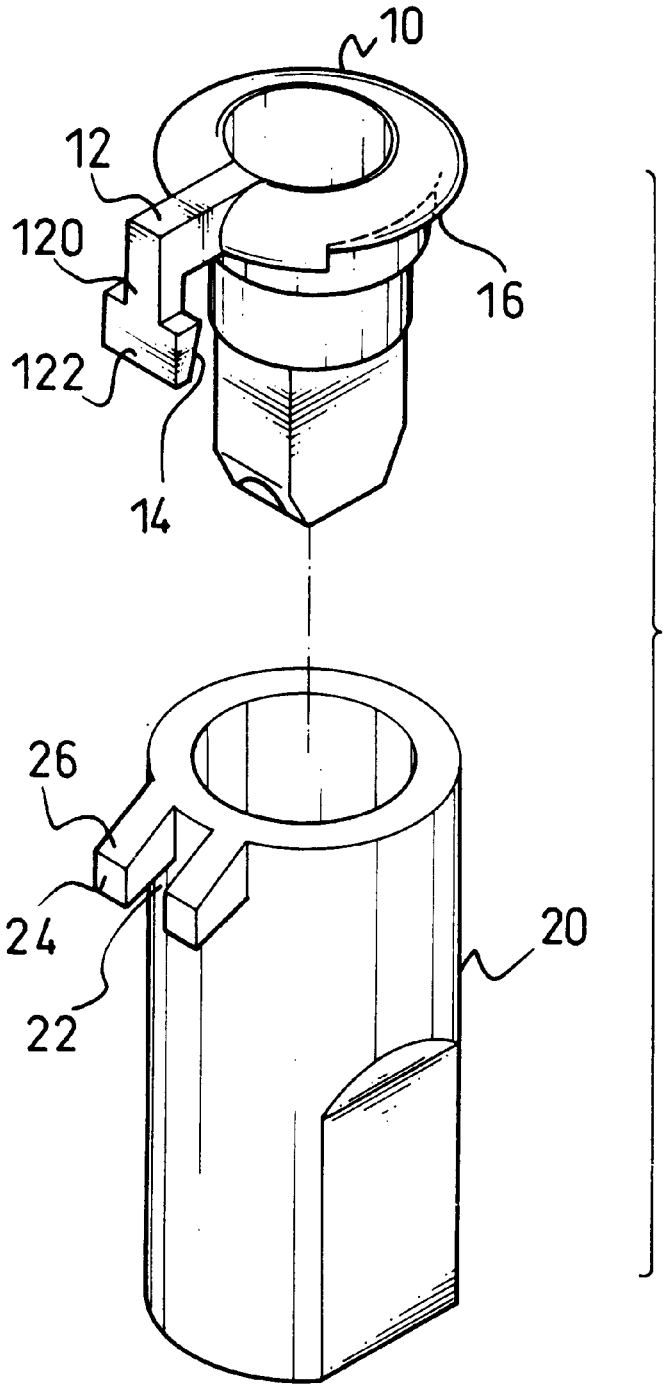
FIG. 1 is an exploded perspective view of a lock joint in accordance with the present invention.

As shown in FIG. 1, a lock joint in accordance with the present invention includes a bulb base (10) and a socket (20). The bulb base (10) has a circular top end (16) integrally formed with a radial extending and downward latch (12). The socket (20) integrally forms two radial extending attachment blocks (24) that define a gap (22) there between for receiving the latch (12) therein.

The latch (12) includes a tongue (120) and a lock (122). Wherein the tongue (120) has a horizontal end integrally formed with the top end of the base (10) and a vertical end integrally formed with the lock (122) that is wider that the tongue (120). Thus the latch (12) has the shape of an inverted T. The lock (122) is tapered to have an interior inclined surface (14), and the top surface of the fixture block (24) also forms a taper (26). Accordingly the latch (12) can slip over the attachment block (24) by pressing it downward.

The gap (22) is wider than the tongue (120) of the latch (12), but narrower than the lock (122). The vertical length of the tongue (120) is long enough to let the upper edge of the lock (122) to be positioned under the lower edge of the attachment block (24) when the lock (122) and the attachment block (24) are joined together.

To assemble the bulb, a worker can easily insert the bulb base (10) into the socket (20) by pressing the latch (12) into the gap (22). Due to the flexibility of the material, the lock (122) slides over the attachment block (24), the tongue (120) fills the gap (22), and the lock (122) catches the lower edge of the attachment block (24). In such a way, the bulb base (10) is positively held in the socket (20) by the lock joint.

Moreover, when a bulb needs to be replaced, it is easy to release them by breaking the lock (122) from the attachment block (24) and pulling bulb base (10) out of the socket (20).

Figure 2:
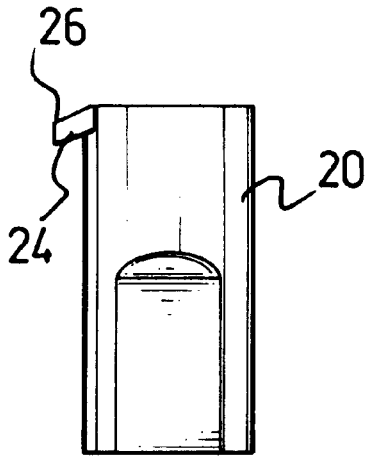
FIG. 2 is a side view of a socket in accordance with the present invention, showing one embodiment of an attachment block.
Figure 3:
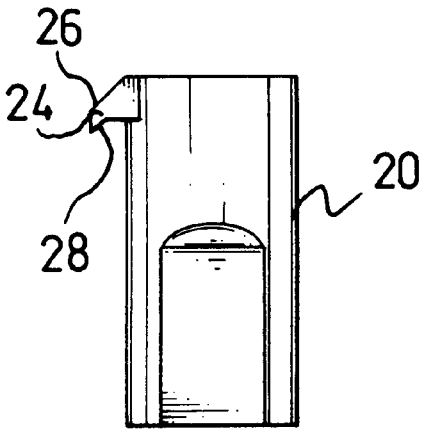
FIG. 3 is a side view of a socket in accordance with the present invention; showing another embodiment of an attachment block.

The attachment block (24) may be shaped as shown in FIG. 2 or FIG. 3. FIG. 3 shows that the attachment block (24) further forms a barb portion (28) for enhancing its lock function.

Figure 4:
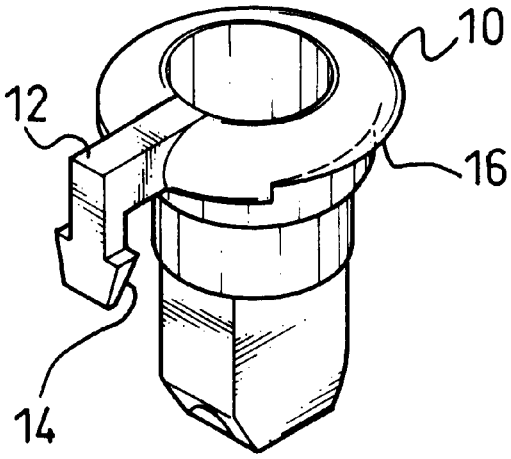
FIG. 4 is a perspective view of a socket in accordance with the present invention, showing one embodiment of a T-shaped latch.
Figure 5:
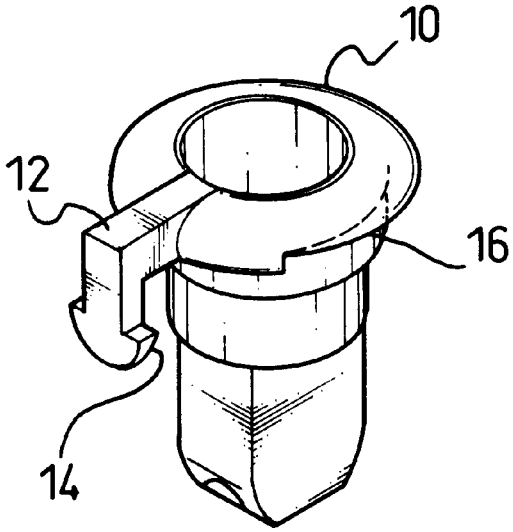
FIG. 5 is a perspective view of a socket in accordance with the present invention, showing another embodiment of a T-shaped latch.

FIGS. 4 and 5 show two different embodiments of the latch (12). The lock (122) of the latch (12) in FIG. 5 is semicircular.

Figure 6:
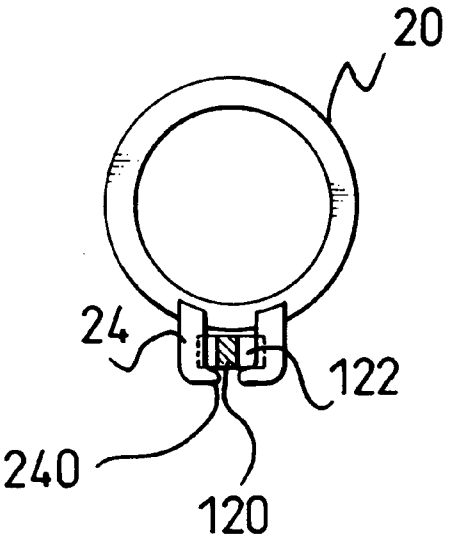
FIG. 6 is a top view of one embodiment in accordance with the present invention, showing the latch locked in the gap of the socket attachment block.

FIG. 6 shows a latch (12) being locked in the attachment block (24), wherein the cross section of the tongue (120) is a rectangle.

Figure 7:
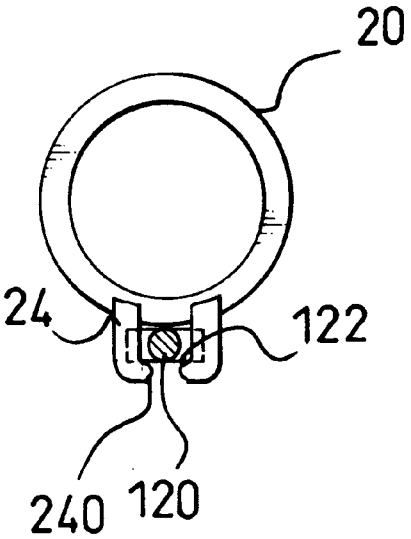
FIG. 7 is a top view of another embodiment of the present invention, showing the latch locked in the gap of the socket attachment block.

FIG. 7 shows another latch (12) being locked in the attachment block (24), wherein the cross section of the tongue (120) is round.

Figure 8:
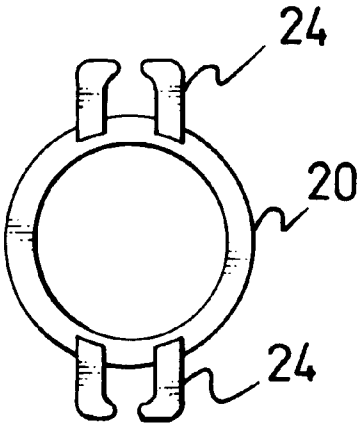
FIG. 8 is a top view of yet another embodiment of the socket of the present invention.

FIGS. 6 to 8 show the attachment blocks (24) are respectively formed an inward hook end (240), the distance between the two hooks ends (240) is appreciably smaller than that of the tongue (122). The socket (20) as shown in FIG. 8 has a pair of attachment blocks (24) provided on opposite sides.

Figure 9:
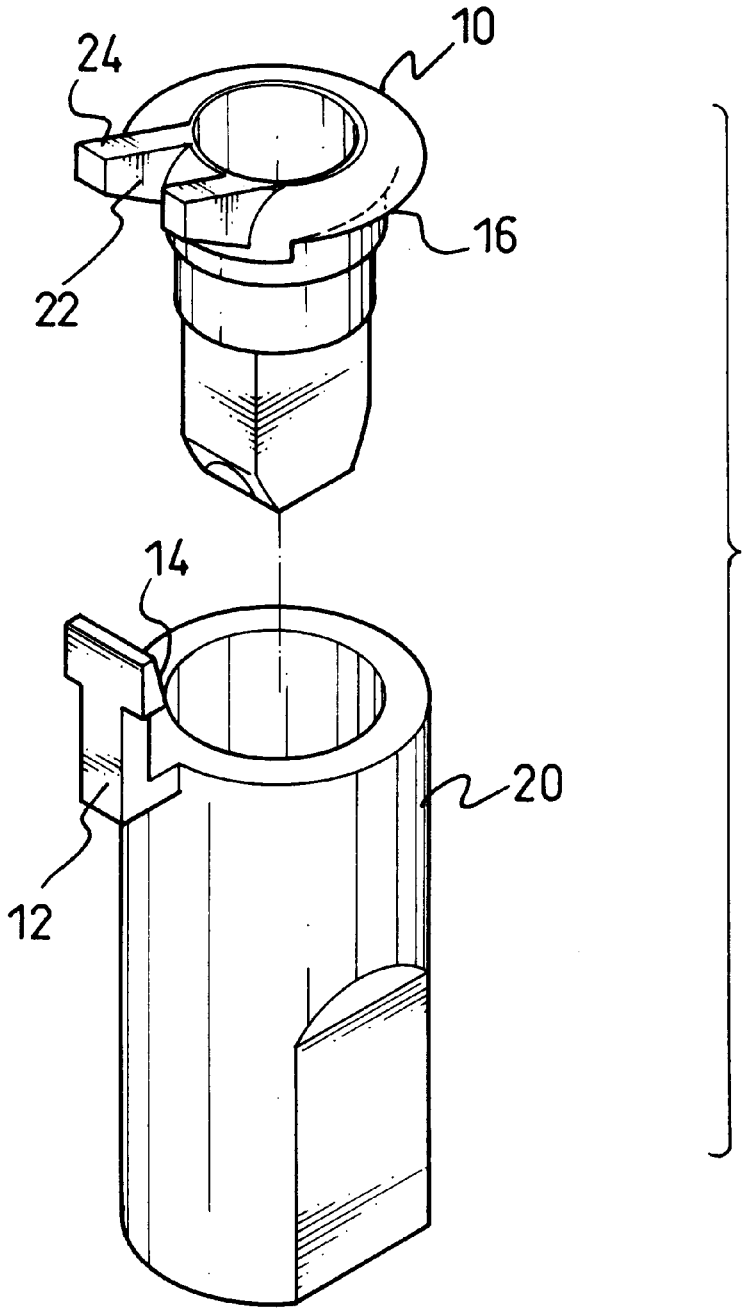
FIG. 9 is a perspective view of another embodiment of the lock joint with the latch and attachment block inverted.
Figure 10:
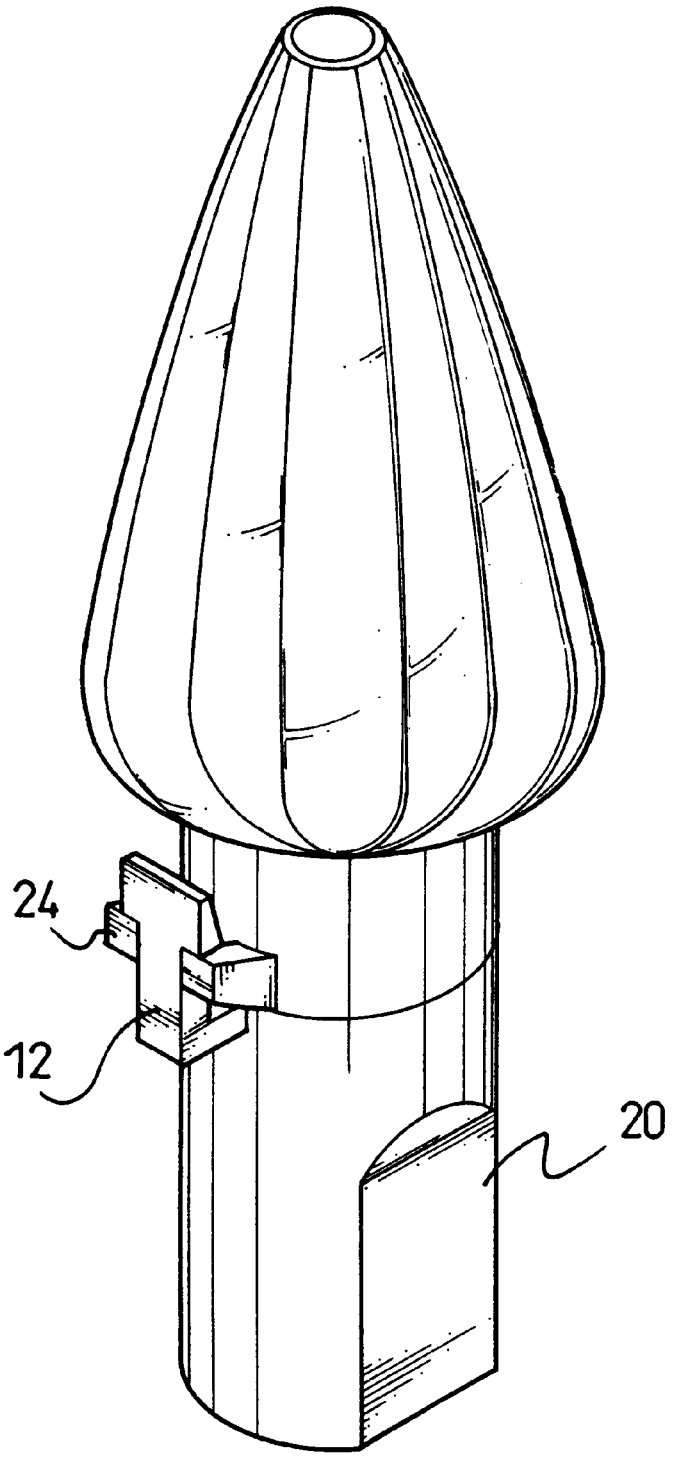
FIG. 10 is a perspective view of the lock joint with the bulb installed therein.
Figure 11:
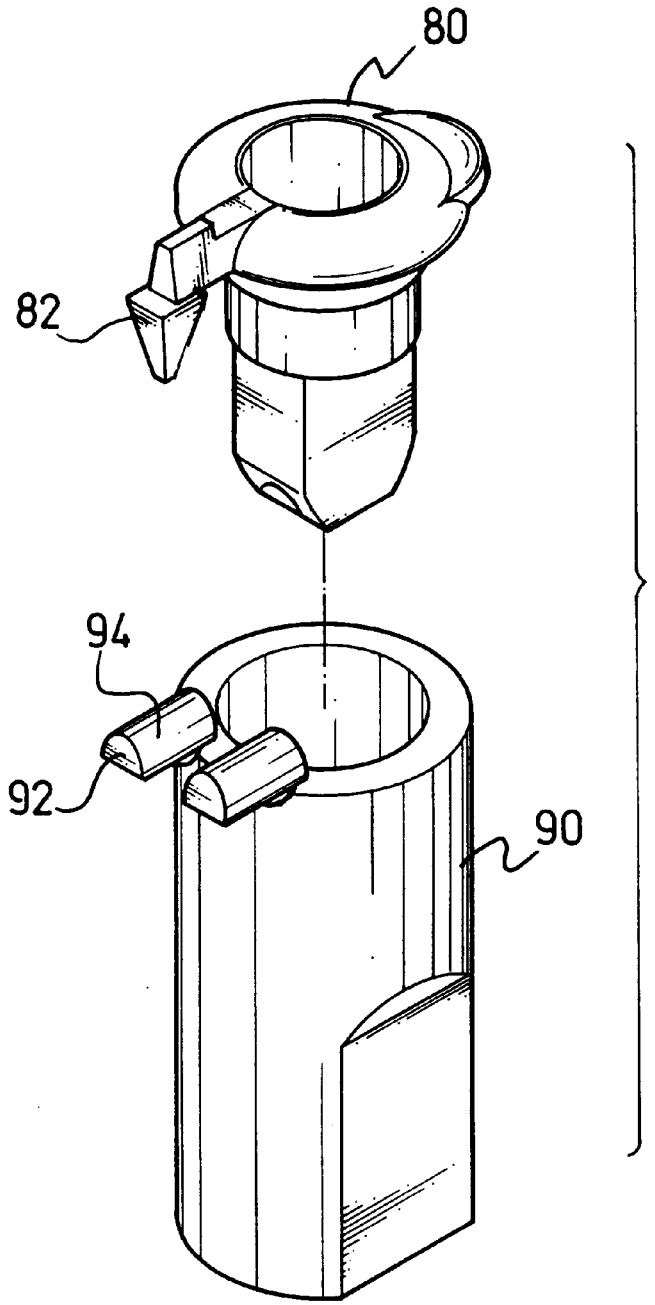
Fig. 11 (Prior Art)
FIG. 11 is a perspective view of a conventional lock joint.

As shown in FIG. 9, the latch (12) and the attachment block (24) are inverted. That is, the latch (12) is formed on the socket (20) and the attachment block (24) is formed on the bulb base (10) and a bulb is installed thereon as shown in FIG. 10.

The present invention is obviously advantageous because of its easy assembly of the bulb with its socket and quick replacement of the bulbs.

What is claimed is:

1. A socket lock for ornament bulbs including a T-shaped latch and two attachment blocks respectively securely provided at the joint between a bulb base and a socket, wherein the improvements comprise:

the latch includes a tongue and a lock which is wider than the tongue;

the tongue has a horizontal end integrally formed at a top end of the bulb base and a vertical end integrally formed into the lock;

the lock is tapered to have an interior inclined surface;

a distance between the two attachment blocks is wider than a width of the tongue and narrower than a width of the lock;

a vertical length of the tongue is longer than the attachment block;

a gap is defined between the two attachment blocks and is wide enough to receive the tongue therein; and wherein the top surface of the attachment block is tapered.

2. The socket lock for ornament bulbs as claimed in claim 1, wherein the T-shaped latch is provided beside the bulb base, and the attachment blocks are provided beside the socket.

3. The socket lock for ornament bulbs as claimed in claim 2, wherein the bulb base and socket are respectively provided with two attachment blocks and corresponding latches on opposite sides.

4. The socket lock for ornament bulbs as claimed in claim 1, wherein the bottom of the attachment block forms a barb.

5. The socket lock for ornament bulbs as claimed in claim 1, wherein the attachment blocks respectively form inward hooks at the end, the distance between the two inward hook ends is appreciably smaller than of the width of the tongue of the latch.

6. A socket lock for ornament bulbs including a T-shaped latch and two attachment blocks respectively securely provided at the joint between a bulb base and a socket, wherein the improvements comprises;

the latch includes a tongue and a lock which is wider than the tongue;

the tongue has a horizontal end integrally formed at the top end of the bulb base and a vertical end integrally formed into a lock;

the lock is tapered to have an interior inclined surface;

the distance between the two attachment blocks is wider than the width of the tongue and narrower than the width of the lock;

the vertical length of the tongue is longer than the attachment block;

a gap is defined between the two attachment blocks and is wide enough to receive the tongue therein;

the T-shaped latch is provided beside the socket, and the attachment blocks are provided beside the bulb base;

the top surface of the attachment block is tapered.

* * * * *